US010030399B1

(12) United States Patent
Haefli

(10) Patent No.: US 10,030,399 B1
(45) Date of Patent: Jul. 24, 2018

(54) ROOF INSPECTION AND REPAIR DEVICE

(71) Applicant: STATE FARM MUTUAL AUTOMOBILE INSURANCE COMPANY, Bloomington, IL (US)

(72) Inventor: Eric Haefli, Bloomington, IL (US)

(73) Assignee: STATE FARM MUTUAL AUTOMOBILE INSURANCE COMPANY, Bloomington, IL (US)

( * ) Notice: Subject to any disclaimer, the term of this patent is extended or adjusted under 35 U.S.C. 154(b) by 0 days.

(21) Appl. No.: 15/228,694

(22) Filed: Aug. 4, 2016

Related U.S. Application Data

(60) Provisional application No. 62/200,939, filed on Aug. 4, 2015.

(51) Int. Cl.
*E04D 15/02* (2006.01)
*E04D 15/04* (2006.01)
*E04G 23/02* (2006.01)

(52) U.S. Cl.
CPC ..... *E04G 23/0281* (2013.01); *E04D 15/02* (2013.01); *E04D 15/04* (2013.01)

(58) Field of Classification Search
CPC ..... E04D 15/003; E04D 15/006; E04D 15/02; E04D 15/04; E04D 15/06; E04D 15/07; E04D 23/0281
USPC ..... 401/48
See application file for complete search history.

(56) References Cited

U.S. PATENT DOCUMENTS 3,099,582 A * 7/1963 Ongstad ..... E04D 15/04 118/410
4,575,279 A * 3/1986 Mateja ..... E01C 19/16 222/501
5,366,308 A * 11/1994 Crispino ..... E04D 15/07 126/343.5 A
5,366,309 A * 11/1994 Springall ..... B05C 5/02 118/108
6,290,428 B1 * 9/2001 Hall ..... E01C 23/096 15/103.5

OTHER PUBLICATIONS

Prototype by David Prevatt of the University of Florida Viewed Aug. 4, 2015.

* cited by examiner

*Primary Examiner* — David Walczak
*Assistant Examiner* — Joshua Wiljanen
(74) *Attorney, Agent, or Firm* — Marshall, Gerstein & Borun LLP; Randall G. Rueth

(57) ABSTRACT

A roof inspection and repair device is disclosed that can be wheeled along a roof to identify loose shingles and dispense the sealant necessary to secure them in place. The roof inspection and repair device has both a blowing system and a sealant dispensing system. The blowing system may include an air tube having an air tube inlet that can be connected to a blower and an air tube outlet. The sealant dispensing system may include one or more sealant storage containers connected to a sealant dispenser by one or more sealant tubes. The roof inspection and repair device may further include a shingle lift mechanism.

18 Claims, 2 Drawing Sheets

ROOF INSPECTION AND REPAIR DEVICE

CROSS-REFERENCE TO RELATED APPLICATION

This application claims priority to U.S. Provisional Patent Application No. 62/200,939 entitled "Roof Inspection and Repair Device," the entire disclosure of which is hereby expressly incorporated by reference herein.

TECHNICAL FIELD

This application relates generally to a roof inspection and repair device for identifying loose shingles and dispensing sealant to secure any identified loose shingles back in place. In particular, this application is directed to a wheeled device having a blower system and a sealant dispensing system and configured to be pushed and actuated by a standing user.

BACKGROUND

During storms, gusts of wind can blow loose shingles off a roof. However, because roof shingles are arranged to overlap, identifying loose shingles in the absence of a powerful wind can be difficult because secure shingles overlapping loose shingles keep the loose shingles in place. Moreover, the application of sealant can be a tedious process that involves lifting up a shingle or tab of a shingle and spreading sealant onto the roof in order to secure the shingle in place.

SUMMARY

Embodiments within the scope of the present disclosure are directed to a roof inspection and repair device that, in some arrangements, can be wheeled along a roof to identify loose shingles and dispense the sealant necessary to secure them in place. In order to achieve these ends, the roof inspection and repair device in some arrangements may have both a blowing system and a sealant dispensing system. In some embodiments within the scope of the present disclosure, the roof inspection and repair device may be configured to be wheeled and actuated by a standing user, thus eliminating the discomfort previously associated with crouching to identify and repair loose shingles.

In some embodiments within the scope of the present disclosure, the blowing system includes an air tube to which other components of the roof inspection and repair device are connected. The air tube may have an air tube inlet that connects the air tube to a blower, an air tube outlet that expels air, and an air tube body that connects the air tube inlet to the air tube outlet. The air tube may be configured such that, when the roof inspection and repair device is in an upright position, the air tube outlet is at or near the bottom of the roof inspection and repair device. When the blowing system is connected to an active blower, air thus may be expelled through the air tube outlet at the level of the shingles. If a shingle or tab of a shingle is insufficiently connected to the roof, the air may be able to slide underneath it and jostle it, making it possible for a user to visually identify loose shingles or tabs. In some embodiments within the scope of the present disclosure, the blowing system may also be used to clean surfaces of shingles prior to sealing a loose shingle in order to create a better seal. In some embodiments within the scope of the present disclosure, the blowing system may be configured such that the air tube inlet is at a height that allows easy access by a user when the user is standing in order to facilitate the user connecting the air tube to a blower. The blower may be carried in a backpack worn by the user or may be secured to the air tube.

Wheels may be connected to the bottom of the air tube body near the air tube outlet and one or more handles may be connected to top of the air tube body near the air tube inlet in order to allow a user to hold the handles and wheel the roof inspection and repair device along a roof. In some embodiments within the scope of the present disclosure, a blower activator may be provided on at least one handle in the form of a button, knob, handgrip, or other mechanism in order to allow a user to activate the blower without letting go of the handles of the roof inspection and repair device. In some embodiments within the scope of the present disclosure, the air tube outlet may expel air in the same direction that the roof inspection and repair device moves when being wheeled forward. In some embodiments within the scope of the present disclosure, the air tube outlet may expel air in a direction perpendicular to the direction that the roof inspection and repair device moves when being wheeled forward. The air tube may be oriented at other angles for expelling the air intermediate between the same direction of movement and the perpendicular to the direction of movement.

In some embodiments within the scope of the present disclosure, the sealant dispensing system may have one or more sealant storage containers connected to the air tube body of the air tube, a sealant dispenser at or near the bottom of the roof inspection and repair device, and one or more sealant tubes connecting each sealant storage container to the sealant dispenser. In some embodiments within the scope of the present disclosure, a single sealant tube connects each sealant storage container to the sealant dispenser, while in other embodiments within the scope of the present disclosure, a plurality of sealant tubes may connect each sealant storage container to the sealant dispenser. In some embodiments within the scope of the present disclosure, the sealant dispenser may have a flat rectangular shape. In other embodiments within the scope of the present disclosure, the sealant dispenser may be a roller. The sealant dispenser may have a plurality of openings through which sealant is dispensed. In some embodiments within the scope of the present disclosure in which the sealant dispensing system has one or more sealant storage containers, certain openings of the plurality of openings may be connected by one or more sealant tubes to certain sealant containers. In some embodiments within the scope of the present disclosure, the sealant dispensing system may further include a sealant dispensing system activator that is provided on at least one handle in the form of a button, knob, handgrip, or other mechanism in order to allow a user to dispense sealant without letting go of the handles of the roof inspection and repair device.

In some embodiments within the scope of the present disclosure, the roof inspection and repair device may further include a shingle lift mechanism. For example, in some embodiments within the scope of the present disclosure, the sealant dispenser may be configured to further function as a shingle lift mechanism by being rectangular with a sloped front. A user may insert the sealant dispenser under the shingle or tab by prying the shingle or tab up with the sloped front and may then rock the roof inspection and repair device back on its wheels in order to further pry the loose shingle or tab up. The user may then dispense sealant below the loose shingle or tab and press the shingle or tab back down. The weight of the roof inspection and repair device may be utilized to help press the shingle or tab back down. In other embodiments within the scope of the present disclosure, the shingle lift mechanism may be distinct from the sealant dispenser and may be a hook, protrusion, or other mechanism.

In some embodiments within the scope of the present disclosure, a method of using a roof inspection and repair device is provided. The roof inspection and repair device may include any one or more of the features disclosed herein. In some arrangements, the method may include wheeling a roof inspection and repair device on wheels using handles along a roof, activating a blower using a blower activator, causing air to travel through an air tube inlet, down an air tube, and out an air tube outlet, identifying loose shingles, dispensing sealant from a sealant storage container, spreading sealant using the sealant dispenser, and/or pressing a loose shingle against dispensed sealant to secure the loose shingle. Air may travel out the air tube outlet in the same direction the roof inspection and repair device is being wheeled. Air may travel out the air tube outlet in a direction perpendicular to the direction the roof inspection and repair device is being wheeled. The method may include jostling loose shingles and/or lifting shingles by using a shingle lift mechanism, which may include rocking the roof inspection and repair device back on its wheels. The sealant may be dispensed from the sealant storage container using a sealant dispensing system activator. Dispensing the sealant may include causing sealant to travel from a sealant storage container through a sealant tube and out through a plurality of openings of the sealant dispenser. The method may include cleaning an area where the loose shingle will be secured by activating the blower. Pressing the loose shingle may include rotating the sealant dispenser over the loose shingle.

BRIEF DESCRIPTION OF THE DRAWINGS

While the specification concludes with claims particularly pointing out and distinctly claiming the subject matter that is regarded as the present disclosure, it is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION

In one arrangement, a roof inspection and repair device has a blowing system that includes an air tube body having an air tube inlet configured to connect to a blower, an air tube body connected to handles and a wheel, and an air tube outlet configured to expel air in the same direction that the roof inspection and repair device moves when being wheeled forward. The roof inspection and repair device also includes a sealant dispensing system having a single sealant storage container connected by a single sealant tube to a rectangular sealant dispenser having a plurality of openings and a sloped front surface that allows the rectangular sealant dispenser to further operate as a shingle lift mechanism.

In another arrangement, a roof inspection and repair device has a blowing system that includes an air tube body having an air tube inlet configured to connect to a blower, an air tube body connected to handles and a wheel, and an air tube outlet configured to expel air in a direction perpendicular to the direction that the roof inspection and repair device moves when being wheeled forward. The roof inspection and repair device also includes a sealant dispensing system having a single sealant storage container connected by a single sealant tube to a sealant dispenser that is a roller.

Figure 1:
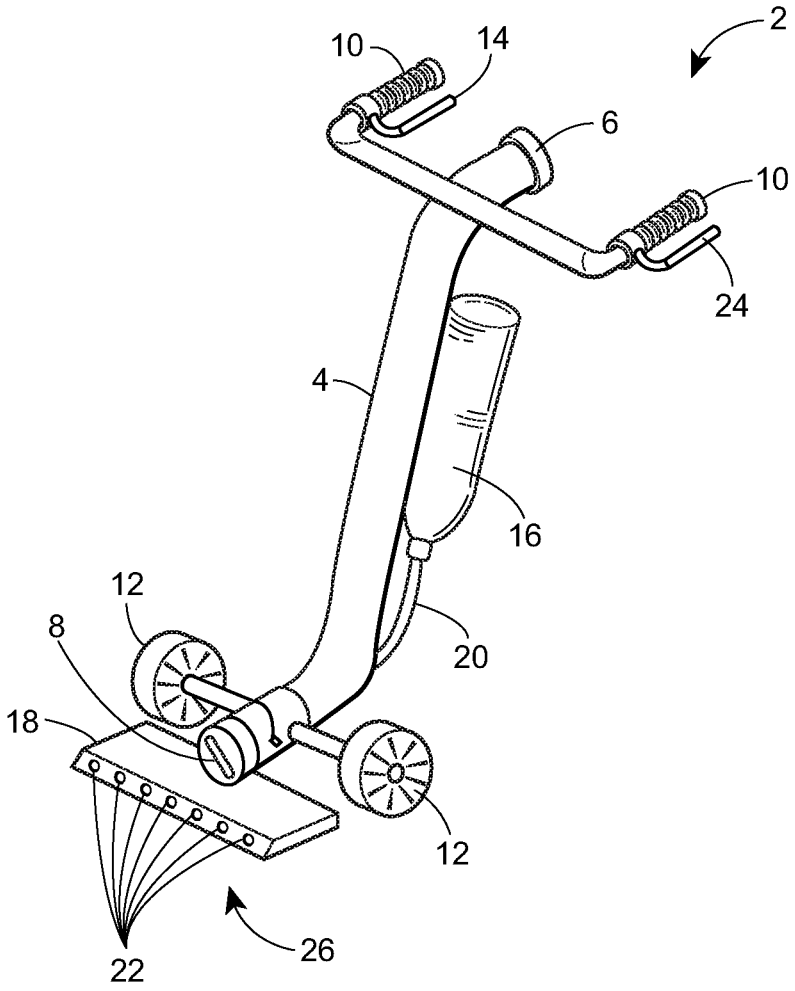
FIG. 1 illustrates a perspective view of a roof inspection and repair device according to an exemplary arrangement.

Referring to the figures in detail, FIG. 1 illustrates an exemplary roof inspection and repair device 2. In this embodiment, the roof inspection and repair device 2 includes a blowing system having an air tube 4, an air tube inlet 6, and an air tube outlet 8. The air tube inlet 6 is configured to attach to a blower (not pictured). In an embodiment, a blower may be provided on the roof inspection and repair device 2, however, in other embodiments, the blower may be provided remote from the roof inspection and repair device 2. Handles 10 and wheels 12 are attached to the air tube 4. The air tube 4 is configured such that the air tube inlet 6 and handles 10 are approximately at a waist height of a typical user (for example between approximately 2 feet and 5 feet high) so as to facilitate moving the roof inspection and repair device 2 and connecting it to a blower. The air tube 4 is further configured such that the air tube outlet 8 expels air in the same direction that the roof inspection and repair device moves when being wheeled forward. A blower activator 14 is provided on one handle 10 in the form of a handgrip. The blower activator 14 could alternately be a button, knob, or any other mechanism that would activate the blower.

The roof inspection and repair device 2 further includes a sealant dispensing system having a sealant storage container 16, a sealant dispenser 18, and a sealant tube 20. Although the embodiment depicted in FIG. 1 includes only a single sealant dispenser 18 and a single sealant tube 20, more than one sealant dispenser 18 could be included in the sealant dispensing system in order to dispense more than one type of sealant. Further, each sealant dispenser 18 could have more than one sealant tube connected to it. The sealant storage container 16 may be a commercially available tubular container of sealant that is attached to the roof inspection and repair device 2. Having a sealant storage container 16 carried on the roof inspection and repair device 2 eliminates the tripping hazard that would arise if, for example, a bucket of sealant was attached to the roof inspection and repair device 2 by tubing. The sealant dispenser 18 has a plurality of openings 22 through which sealant is dispensed. In alternate embodiments having multiple sealant storage containers, some openings of the plurality of openings 22 could be connected by one or more sealant tubes 20 to one sealant storage container 16 while other openings of the plurality of openings 22 could be connected by one or more sealant tubes 20 to another sealant storage container 16. A sealant dispensing system activator 24 is provided on one handle 10 in the form of a handgrip. The sealant dispensing system activator 24 could alternately be a button, knob, or any other mechanism that would activate the sealant dispensing system. Further, multiple sealant dispensing system activators 24 could be provided in embodiments having more than one sealant storage container 16.

The sealant dispenser 18 has a sloped front surface 26 that allows it to act as a shingle lift mechanism. A user may forcibly insert the sealant dispenser 18 under a shingle that has been identified as loose using the sloped front surface 26 and then rock the roof inspection and repair device 2 back on its wheels 12 in order to further pry the loose shingle up. Sealant dispenser 18 may be configured in other ways to function as a shingle lift mechanism, and structures distinct from the sealant dispenser 18, such as a hook, protrusion, or other mechanism, may function as a shingle lift mechanism.

Figure 2:
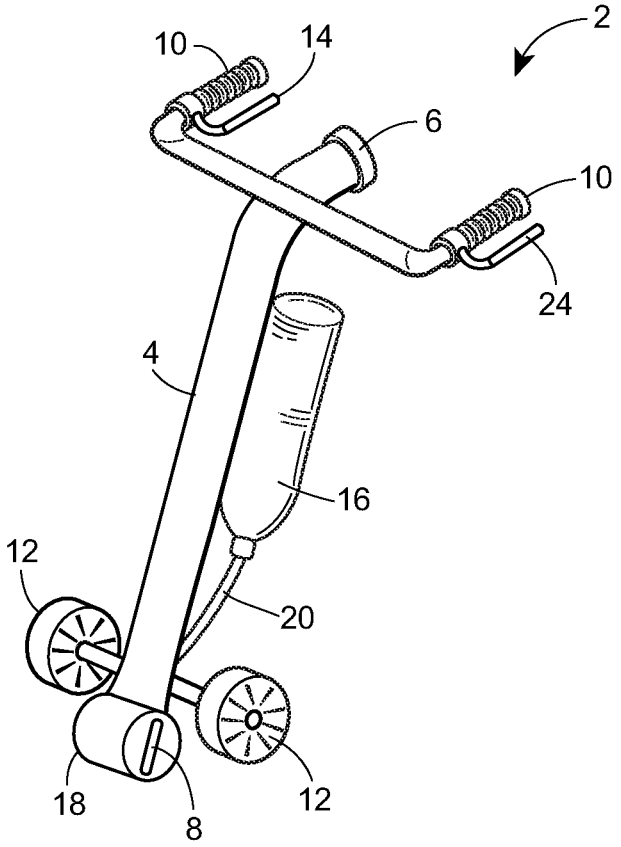
FIG. 2 illustrates a perspective view of a roof inspection and repair device according to another exemplary arrangement.

FIG. 2 illustrates an exemplary roof inspection and repair device 2 similar to that disclosed in FIG. 1 except as described hereinafter. Thus, the reader is referred to the previous description for additional details not addressed hereinafter. In this embodiment, the sealant dispenser 18 is in the form of a roller rather than in the form of a shingle lift mechanism. Further, the air tube outlet 8 is located in the center of the roller and expels air in a direction perpendicular to the direction that the roof inspection and repair device moves when being wheeled forward. Thus, in this embodiment, the roof inspection and repair device 2 does not include a shingle lift mechanism. However, in other embodiments, a shingle lift mechanism may also be provided along with the roller. One benefit of having the sealant dispenser 18 be a roller is that the roller can be rotated over a loose shingle after sealant has been dispensed in order to help secure the loose shingle in place.

In use, the roof inspection and repair device 2 is wheeled on wheels 12 using handles 10 by a user along a roof. The user may activate a blower, which may be attached to the roof inspection and repair device 2, to expel air ideally having a velocity of 100 miles per hour or greater. The activation of the blower may be accomplished by the blower activator 14. Upon activation, air travels from the blower through the air tube inlet 6, down the air tube 4, and is expelled near the shingles of the roof by the air tube outlet 8. The air may be expelled in a the same direction the user is wheeling the roof inspection and repair device 2 (as shown in FIG. 1), in a direction perpendicular to the direction the user is wheeling the roof inspection and repair device 2 (as shown in FIG. 2), or in a direction intermediate between the direction of wheeling and perpendicular to the direction of wheeling. The expelled air jostles loose shingles, which may then be identified by the user. The user may use a shingle lift mechanism, such as the sloped surface 26 of the rectangular sealant dispenser 18 of FIG. 1, to lift up a loose shingle or may lift the loose shingle by hand or with another type of shingle lift mechanism. The user may activate the blower again to expel air through the air tube outlet 8 in order to clean the area to which the loose shingle will be sealed or re-sealed so that a better seal can be formed. The user may then dispense sealant contained in the one or more sealant storage containers 16 by compressing the sealant dispensing system activator 24. Sealant from the one or more sealant storage containers 16 is dispensed by traveling down the one or more sealant tubes 20 and out the sealant dispenser 18. The sealant dispenser 18 may have a plurality of openings 22 so the sealant may travel through one or more of the plurality of openings 22. After being dispensed, the sealant may be spread by the sealant dispenser 18 and the loose shingle may be pressed down to secure it in place. In particular, if the sealant dispenser 18 is in the form of the roller of FIG. 2, the loose shingle may be pressed down to secure it in place by rotating the sealant dispenser 18 over the loose shingle.

The patent claims at the end of this patent application are not intended to be construed under 35 U.S.C. § 112(f) unless traditional means-plus-function language is expressly recited, such as "means for" or "step for" language being explicitly recited in the claim(s).

The invention claimed is:

1. A roof inspection and repair device comprising:
a blowing system including an air tube having an air tube inlet configured to connect to a blower and an air tube outlet;
handles and wheels connected to the air tube;
a sealing dispensing system including one or more sealant storage containers connected to a sealant dispenser; and
further including a shingle lift mechanism,
wherein a sloped front surface of the sealant dispenser is configured to be the shingle lift mechanism.

2. The roof inspection and repair device of claim 1, wherein the sealant dispenser includes a plurality of openings.

3. The roof inspection and repair device of claim 1, further including a blower activator that includes at least one of a handgrip, button, and knob.

4. The roof inspection and repair device of claim 1, further including a sealant dispensing system activator, which includes at least one of a handgrip, button, and knob.

5. The roof inspection and repair device of claim 1, wherein the air tube outlet is configured to expel air in the same direction that the roof inspection and repair device moves when being wheeled forward.

6. A roof inspection and repair device of claim 1, wherein the sealant dispenser is configured as a roller.

7. A roof inspection and repair device comprising:
a blowing system including an air tube having an air tube inlet configured to connect to a blower and an air tube outlet;
handles and wheels connected to the air tube; and
a sealing dispensing system including one or more sealant storage containers connected to a sealant dispenser,
wherein the air tube outlet is configured to expel air from the roof inspection and repair device during use,
wherein the sealant dispenser includes a plurality of openings, and
further including two or more sealant storage containers, wherein some openings of the plurality of openings are connected by one or more sealant tubes to one sealant container while other openings of the plurality of openings are connected by one or more sealant tubes to another sealant container.

8. The roof inspection and repair device of claim 7, further including a shingle lift mechanism.

9. The roof inspection and repair device of claim 7, further including a blower activator that includes at least one of a handgrip, button, and knob.

10. The roof inspection and repair device of claim 7, further including a sealant dispensing system activator, which includes at least one of a handgrip, button, and knob.

11. The roof inspection and repair device of claim 7, wherein the air tube outlet is configured to expel air in the same direction that the roof inspection and repair device moves when being wheeled forward.

12. A roof inspection and repair device of claim 7, wherein the sealant dispenser is configured as a roller.

13. A roof inspection and repair device comprising:
a blowing system including an air tube having an air tube inlet configured to connect to a blower and an air tube outlet;
handles and wheels connected to the air tube; and
a sealing dispensing system including one or more sealant storage containers connected to a sealant dispenser,
wherein the air tube outlet is configured to expel air from the roof inspection and repair device during use,
wherein the sealant dispenser is configured as a roller, and wherein the air tube outlet is configured to expel air in a direction perpendicular to the direction that the roof inspection and repair device moves when being wheeled forward.

14. The roof inspection and repair device of claim 13, wherein the air tube outlet is contained within the roller.

15. The roof inspection and repair device of claim 13, wherein the sealant dispenser includes a plurality of openings.

16. The roof inspection and repair device of claim 13, further including a shingle lift mechanism.

17. The roof inspection and repair device of claim 13, further including a blower activator that includes at least one of a handgrip, button, and knob.

18. The roof inspection and repair device of claim 13, further including a sealant dispensing system activator, which includes at least one of a handgrip, button, and knob.

* * * * *